United States Patent [19]

Gruzling

[11] 4,217,844

[45] Aug. 19, 1980

[54] BARGE DAGGER SKEGS

[75] Inventor: Josip Gruzling, North Vancouver, Canada

[73] Assignee: Seaspan Development Co. Ltd., North Vancouver, Canada

[21] Appl. No.: 870,034

[22] Filed: Jan. 16, 1978

Related U.S. Application Data

[63] Continuation of Ser. No. 802,140, May 31, 1977, abandoned, which is a continuation of Ser. No. 688,014, May 19, 1976, abandoned.

[51] Int. Cl.[2] ..... B63B 1/00

[52] U.S. Cl. ..... 114/63; 114/129; 114/163

[58] Field of Search ..... 114/25, 56, 57, 63, 114/65, 129, 144 R, 149, 152, 163, 164, 374, 140

[56] References Cited

U.S. PATENT DOCUMENTS

| | | | |
|---|---|---|---|
| 1,070 | 1/1839 | Jackson | 114/163 |
| 2,068,921 | 1/1937 | Leigh | 114/26 |
| 3,080,845 | 3/1963 | Pollak | 114/140 |
| 3,750,607 | 8/1973 | Seymour et al. | 114/65 R |
| 3,828,713 | 8/1974 | Duryea | 114/163 |
| 3,934,531 | 1/1976 | Allen | 114/63 |

*Primary Examiner*—Trygve M. Blix
*Assistant Examiner*—Jesús D. Sotelo
*Attorney, Agent, or Firm*—Robert W. Beach

[57] ABSTRACT

A row of dagger skegs projects downward from the aft portion of the raked counter of a nonpowered, nonsteered barge hull at each side of the longitudinal center line of the hull for stabilizing the barge directionally when towed by a towline trailing a towboat. The upright skegs are of airfoil cross section, and they are tapered downwardly. The leading edge of each skeg, which extends over the major portion of the height of the skeg, is substantially vertical and is spaced rearwardly from the stern counter. The lower end portions of adjacent skegs can be connected by an elongated horizontal bridging member which also is of airfoil cross section having a cambered upper side and a negative angle of incidence.

8 Claims, 10 Drawing Figures

BARGE DAGGER SKEGS

This application is a continuation of application Ser. No. 802,140, filed May 31, 1977, for Barge Dagger Skegs, now abandoned, which was a continuation of application Ser. No. 688,014, filed May 19, 1976, for Barge Dagger Skegs, also now abandoned.

BACKGROUND OF THE INVENTION

1. Field of the Invention

This invention relates to skegs for barges to stabilize towed barges directionally by deterring yawing.

2. Prior Art

Skegs are customarily provided on the raked counter of the stern overhang of barges to deter yawing of a barge when towed by a towline trailing a towboat. Such skegs extend fore and aft over substantially the entire fore-and-aft extent of the barge stern counter, and their lower edges are at approximately the same elevation as the bottom of the barge. Such skegs are of low aspect ratio, have no leading edge portion spaced from the stern counter of the barge and are in the form of flat or cambered plates as distinguished from being of airfoil cross section. Usually two of such skegs are provided, arranged symmetrically at opposite sides of the longitudinal vertical central plane of the barge.

Such conventional skegs are not very efficient in deterring yaw of a barge which is not self-propelled but is towed by a towline connected to its bow, and they do increase the drag of the barge a substantial amount over the drag of a similar barge having no skegs.

SUMMARY OF THE INVENTION

It is a principal object of this invention to provide skegs for a barge which are more effective than conventional skegs in producing directional stability and which reduce drag.

More particularly, it is an object to provide skegs for a barge which not only will not produce drag, such as produced by conventional skegs, but which will reduce the wake and/or the turbulence of the barge wake so as actually to reduce the drag normally produced by the barge hull.

Another object is to utilize skeg structure of simple streamlined design having hydrodynamically desirable characteristics.

The foregoing objects can be accomplished by utilizing several dagger type skegs that is, skegs having a high aspect ratio of sufficient area and of airfoil cross section. Other characteristics of the skegs are designated by terms relating to airfoils. Their spans are upright. They have high aspect ratio whereas conventional skegs are of flat-or cambered plate structure having low aspect ratio.

DETAILED DESCRIPTION

Figures 1, 2, 3, 4, 5:
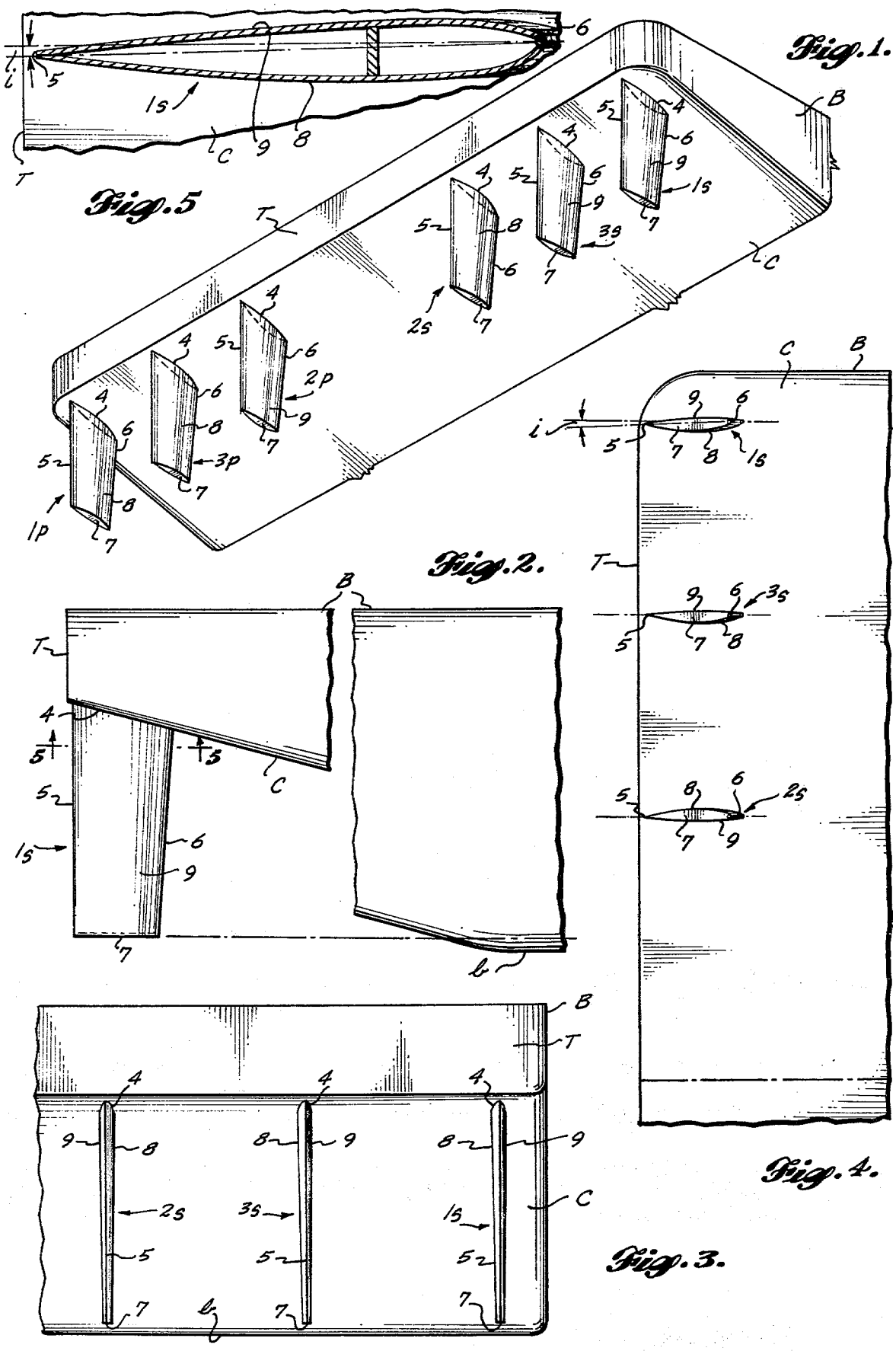
FIG. 1 is a bottom perspective of the stern portion of a barge showing an arrangement of skegs according to the present invention projecting downward from the barge counter.
FIG. 2 is a side elevation.
FIG. 3 is a stern elevation and FIG. 4 is a bottom plan of the starboard stern portion of a barge equipped with skegs according to the present invention.
FIG. 5 is a detail horizontal section through a skeg taken on line 5—5 of FIG. 2.

Two benefits are obtained by utilization of the present invention which are interrelated, namely, an increase in effectiveness of the skeg structure to improve the directional stability of the barge by deterring yaw and a decrease in the drag of the barge which reduces the power necessary to propel the barge, or which results in an increase in speed of the barge if the same propulsive power is used. Increase in the effectiveness of the skeg structure to improve directional stability is obtained by locating the skeg structure substantially as far aft as possible, by each skeg of the skeg structure having a high aspect ration, being designated a dogger skeg, being of airfoil cross section, by arranging the skeg elements at desirable angles of incidence, by minimizing tip loss and by spacing adajacent skeg elements at a sufficient interval to minimize flow interference between them. Reduction in drag is accomplished by utilizing skegs of airfoil cross section arranged advantageously, by minimizing tip loss and by spacing adjacent skeg elements at a sufficient interval to minimize flow interference.

Two representative skeg installations according to the present invention are shown in the drawings, one being shown in FIGS. 1 to 5 inclusive and a modification being shown in FIGS. 6 to 10 inclusive. The second form of the invention includes the components shown in the first form of the invention, and such components are numbered correspondingly in such second form. The skeg structure is applied to the conventional raked stern counter C of a conventional barge B having a flat bottom b. The principle of the invention is applicable to barges of all sizes but is more beneficial when used on barges of medium size, 250 feet to 350 feet (76.200 meters to 106.680 meters) in length, or large barges, 350 feet to 450 feet (106.680 meters to 137.160 meters) in length, rather than to small barges, 150 feet to 250 feet (45.720 meters to 76.200 meters) in length.

The degree of the rake of counter C is not critical and may be within the range of 10° to 40° to the horizontal, but it is preferred that the rake be within the range of 15° to 20° to horizontal. Also, the height of the transom T of the barge is not critical but preferably is from 20% to 35% of the total depth of the barge. In the representative barge shown in the drawings, the rake angle is approximately 15° and the height of the transom is approximately 28% of the total depth of the barge.

The dagger skegs of the present invention are in two sets arranged symmetrically at opposite sides of the longitudinal center line of the barge. Each set includes a plurality of dagger skegs directionally fixed relative to the stern counter, three skegs being shown in each set illustrated in the drawings. The port set includes an outboard skeg 1*p* and an inboard skeg 2*p*, and may include one or more intermediate skegs 3*p*. Correspondingly, the starboard set of dagger skegs includes an outboard skeg 1*s* and an inboard skeg 2*s* and may include one or more intermediate skegs 3s. The skegs in each set are arranged in a row extending athwartships of the barge and preferably the skegs are of substantially the same height, chord and spanwise taper.

Each skeg element is preferably of airfoil cross section, as shown in FIG. 5, a typical suitable cross section being a Clark Y section or a NASA 22012 section established by criteria of the National Aeronautics and Space Administration. Each dagger skeg element includes a root end 4 suitably secured to the aft portion of the barge counter C. The trailing edge 5 preferably is vertical, and the leading edge 6 preferably is swept back a moderate amount from the root end 4 to the bottom tip 7.

As shown in FIG. 5, the airfoil section forms a cambered side 8 and a side 9 which may be cambered to the same or a lesser degree, or which may be flat. If the opposite sides of the skeg elements have different degrees of camber, it is preferred that the outboard skegs 1p and 1s have the greatest difference in camber, that the inboard skegs 2p and 2s have the next greatest different in camber, and that the intermediate skegs 3p and 3s have the least difference in camber. It would not be objectionable for all of the dagger skeg elements to be of symmetrical airfoil cross sections, and the difference in action of the skegs be effected by selecting proper angles of incidence for the skeg elements.

Where the inboard and outboard skeg elements are of nonsymmetrical cross section, the most highly cambered side of the outboard skeg elements 1s and 1p should face inward and the most highly cambered sides of the inboard skeg elements 2p and 2s may face outward or inward. The cambered inner side of the outboard skeg in each set and the cambered outer side of the inboard skeg of each set will then cooperate to provide a venturi passage between the inboard skeg and the outboard skeg of each set which will guide the wake of the barge between such skeg elements and reduce the turbulence in such portion of the wake, thus correspondingly reducing the drag on the barge. If the intermediate skeg elements 3p and 3s are of symmetrical airfoil cross section, they will not interfere with the flow. If their sides are cambered unequally, it is preferred that the side having the greater camber be on the inner side of the skeg element, as shown in FIG. 4, to form the venturi passage nearer the center of the barge.

Each skeg element is of high aspect ratio, as shown in FIG. 2, so that it is appropriately designated as a "dagger" skeg. Such aspect ratio should be within the range between and including 2 to 1 and 8 to 1 and preferably is within the range between and including 2½ to 1 and 4 to 1. The aspect ratio of the dagger skegs shown in FIG. 2 is approximately 2½ to 1. The tip 7 of the dagger skeg should not project below and preferably should be slightly above the bottom b of the barge B, as shown in FIG. 2. The sweptback leading edge 6 of the skeg is spaced a substantial distance aft of barge bottom b. Also the fore and aft extent or chord of the root 4 is a small fraction of the fore and aft extent or run of the counter C.

The average chord of each dagger skeg element is selected so that the total profile area of all of the skeg elements in each set will be less than the substantially triangular area formed by the raked surface of counter C as one side, the fore and aft extent or run of the counter C as a second side, and the elevation between the bottom of the transom T and the elevation of the barge bottom b as the third side. Thus combined fin areas of all the dagger skegs in each set will be less than the area of the corresponding single conventional substantially triangular skeg.

The efficiency of the dagger skegs in providing directional or jaw stability for the barge depends not only on the total fin area, but also on the location of the skeg elements and their angles of incidence. To be most effective, the dagger skeg elements should be located as far aft as possible, as shown in FIGS. 1 and 2. Also, the outboard skeg elements 1p and 1s should be toed out in the direction of travel of the barge at an angle i of 2° to 10°. The inboard skegs 2p and 2s may be toed in to some extent, such as 2° to 10°. Intermediate skegs 3p and 3s should have 0° angle of incidence, or a small angle of incidence in one direction or the other, depending on the camber of such intermediate skeg elements and the flow pattern preferred. Also, the angles of incidence of the port skeg elements and of the starboard skeg elements need not be identical if a difference in such angles of incidence will cause the barge to follow a straighter course by reducing yaw.

Both to reduce the wake of the barge and the turbulence of the wake and to increase the effectiveness of the skeg elements in controlling directional stability, the adjacent skeg elements in a set should not be placed too close together, nor should the sets of elements at opposite sides of the longitudinal vertical central plane of the barge be placed too close together. It is preferred that the spacing between adjacent skeg elements be at least as great as the maximum chord of the skeg elements and approximately twice the mean chord of the skeg elements, as shown in FIG. 4. While two skeg elements could be used in each set, or more than three could be used, it is preferred that there be three skeg elements in each set. If there are more than three, the aspect ratio of the skeg elements should be increased by reducing the mean chord of each element. Consequently, adjacent skeg elements could be located closer together, but they should not be closer than 1½ times the mean chord to provide the best yaw-deterring performance and the greatest reduction in drag. Also the two outboard skeg elements of the sets are located closer to the respectively adjacent sides of the barge than one-half of the spacing between each outboard skeg and the next inboard skeg of the set, as shown in FIG. 4.

Figure 10:
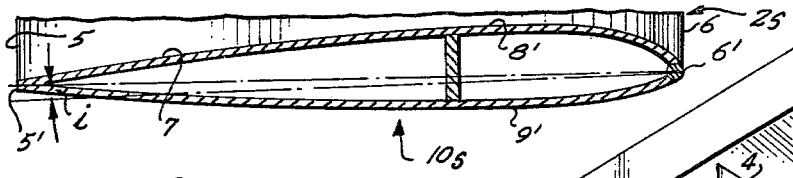
FIG. 10 is an enlarged fragmentary vertical section through a portion of the skeg structure taken along 10—10 of FIG. 9.
Figure 6:
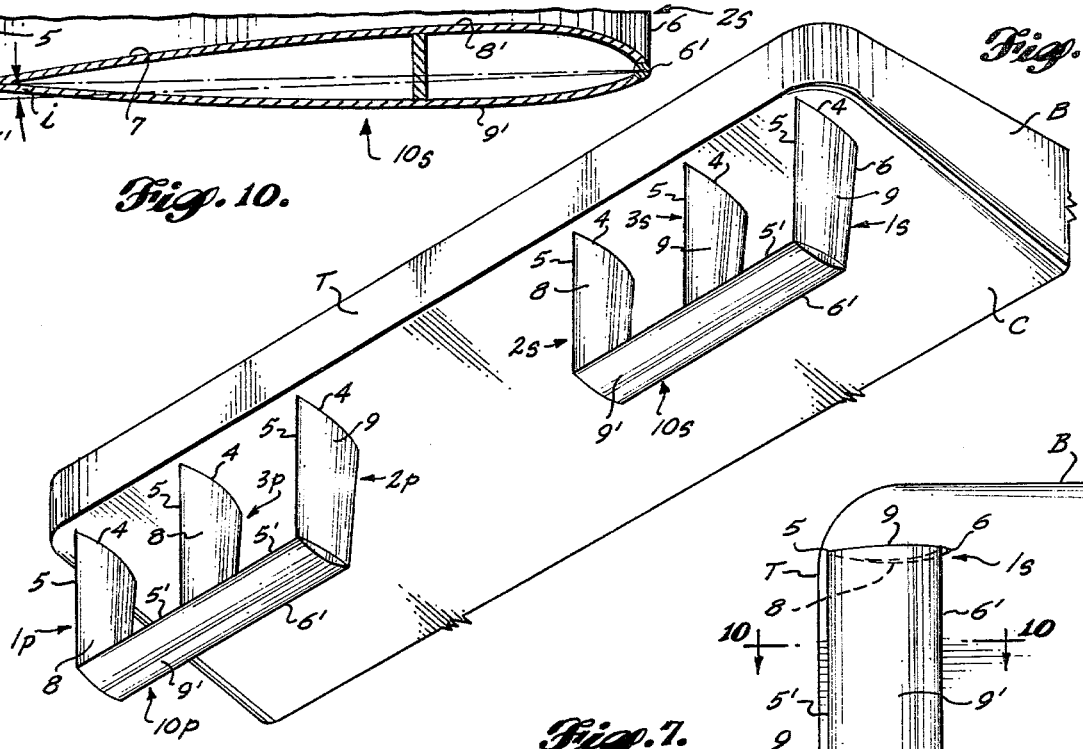
FIG. 6 is a bottom perspective of the stern portion of a barge equipped with a modified skeg construction according to the present invention.
Figure 7:
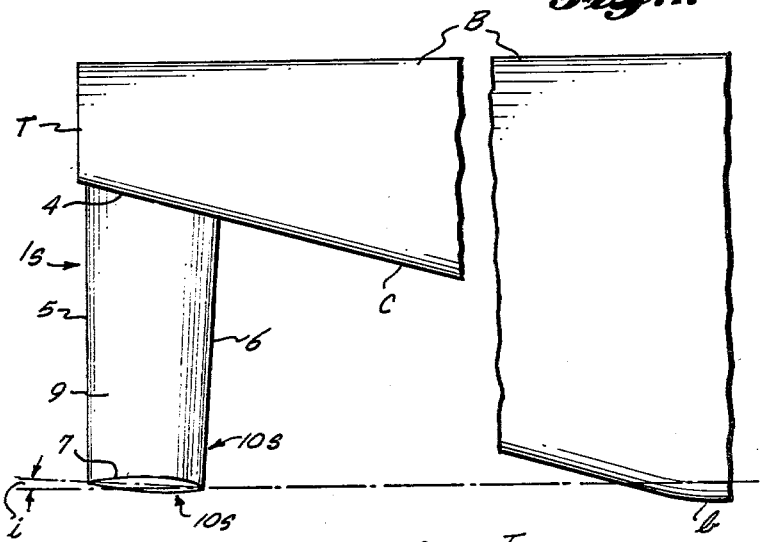
FIG. 7 is a side elevation.
Figure 9:
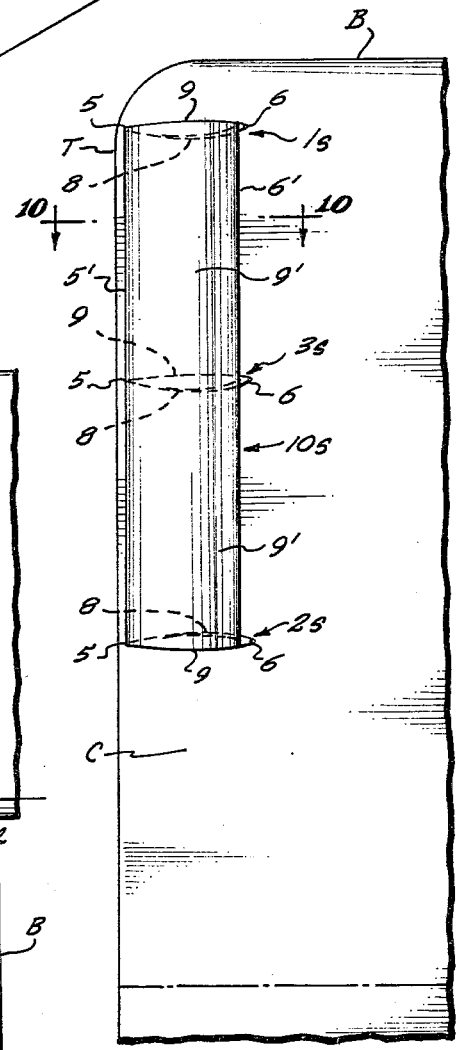
FIG. 8 is a rear elevation and FIG. 9 is a bottom plan of the starboard stern portion of a barge equipped with skeg construction of the type shown in FIG. 6.
Figure 8:
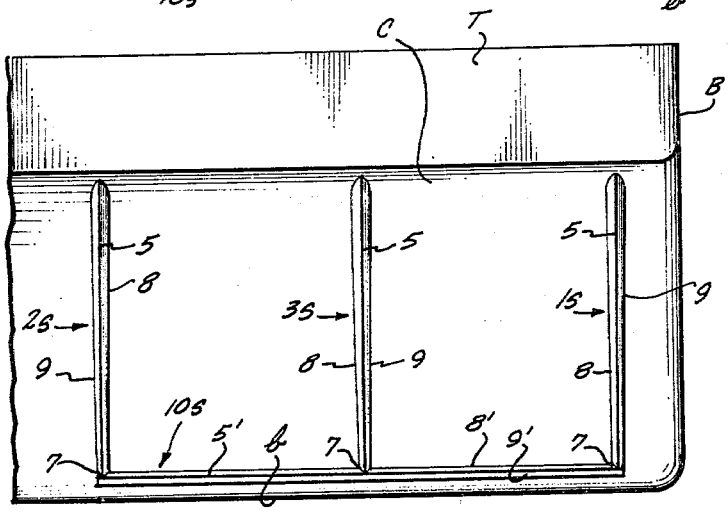

The individual cantilever dagger skegs shown in FIGS. 1 to 4, inclusive, are somewhat vulnerable to being struck by floating objects over which the barge B may be towed. The skegs can be unified and strengthened by connecting the lower portions of the skegs in each set at opposite sides of the longitudinal center line with an elongated bridging plate member extending athwartships and preferably substantially horizontally and located at least as high as the bottom of the barge. The bridging member 10p is shown in FIG. 6 as connecting the tips of the port skegs 1p, 3p and 2p, and the bridging member 10s is shown as connecting the tips of the starboard skegs 1s, 3s and 2s. Each of the elongated bridging members is of airfoil cross section and is shown in FIG. 10 as including a trailing edge 5', a leading edge 6', an upper cambered side 8' and a lower side 9' which either is of lesser camber or is flat.

The cambered upper side 8' of the bridging member cooperates with the cambered sides of the inboard and outboard skegs of the set to confine a venturi flow of the wake to a greater extent than the wake would be confined without such bridging member. Also, it is preferred that the skeg bridging members have a negative angle of incidence within the range of 2° to 10° to provide a forward hydrodynamic reaction component for reducing or offsetting drag.

Not only does the horizontal bridging member reduce turbulence by its cambered upper side promoting venturi flow, and reduce drag because of its forward hydrodynamic reaction component, but the fact that such bridging member covers the tips of the dagger skegs reduces the turbulence around such tips and decreases drag. The interconnection of the individual skegs by the bridging member also deters possible tendency of an individual skeg to vibrate and generally increases the strength of each set of skegs as a composite structure.

I claim:

1. A barge comprising a nonpowered, nonsteered hull designed for towing by a towline trailing a towboat, said hull having a substantially flat bottom and a raked stern counter, a set of skegs projecting downward from the aft portion of said stern counter at each set of the hull longitudinal center line for effecting yaw stability of said hull, each set including a plurality of skegs arranged in a row extending athwartships of the barge and directionally fixed relative to said stern counter, the lower end of each skeg being higher than the barge bottom and each skeg having a height greater than its maximum chord, corresponding skegs at opposite sides of said hull longitudinal center line having their chords toed out in the direction of travel of the barge.

2. A barge comprising a nonpowered, nonsteered hull designed for towing by a towline trailing a towboat, said hull having a substantially flat bottom and a raked stern counter, a set of skegs projecting downward from the aft portion of said stern counter at each side of the hull longitudinal center line for effecting yaw stability of said hull, each set including a plurality of skegs arranged in a row extending athwartships of the barge and directionally fixed relative to said stern counter, the lower end of each skeg being higher than the barge bottom and each skeg having a height greater than its maximum chord, and elongated bridging members at opposite sides of the hull longitudinal center line at least as high as the hull bottom having their lengths extending transversely of the barge and each bridging member connecting the lower portions of the plurality of skegs in the respective set at one side of such center line, the inboard ends of said bridging members being spaced apart and located at opposite sides, respectively, of the hull longitudinal center line.

3. The barge defined in claim 2, the elongated bridging members including plate means having at least one cambered side.

4. The barge defined in claim 3, the plate means having its cambered side facing upward.

5. The barge defined in claim 2, each of the elongated bridging members including plate means having a negative angle of incidence.

6. The barge defined in claim 2, skegs at each side of the hull longitudinal center line connected by each elongated bridging member having cambered sides facing each other and each elongated bridging member including plate means having a cambered upper side.

7. The barge defined in claim 2, skegs at one side of the hull longitudinal center line connected by an elongated bridging member being towed out in the direction of travel of the barge, and such elongated bridging member including plate means having a negative angle of incidence.

8. The barge defined in claim 2, each set of skegs projecting downward from the stern counter at each side of the hull longitudinal center line including at least three skegs.

* * * * *

UNITED STATES PATENT AND TRADEMARK OFFICE

CERTIFICATE OF CORRECTION

PATENT NO. : 4,217,844
DATED : August 19, 1980
INVENTOR(S) : Josip Gruzling

It is certified that error appears in the above-identified patent and that said Letters Patent are hereby corrected as shown below:

Column 5, line 20, cancel "set" and insert --side--.

Column 6, line 29, cancel "towed" and insert --toed--.

Signed and Sealed this

*Tenth* Day of *November 1981*

[SEAL]

*Attest:*

GERALD J. MOSSINGHOFF

*Attesting Officer*

*Commissioner of Patents and Trademarks*